US006515424B2

(12) United States Patent
Nakamura et al.

(10) Patent No.: US 6,515,424 B2
(45) Date of Patent: Feb. 4, 2003

(54) COLOR CATHODE RAY TUBE HAVING AN INTERNAL VOLTAGE-DIVIDING RESISTOR

(75) Inventors: Hisao Nakamura, Mobara (JP); Sachio Koizumi, Mobara (JP); Kenji Suzuki, Mobara (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/953,556

(22) Filed: Sep. 17, 2001

(65) Prior Publication Data

US 2002/0053888 A1 May 9, 2002

(30) Foreign Application Priority Data

Sep. 20, 2000 (JP) ..... 2000-284702

(51) Int. Cl.[7] ..... H01J 23/16

(52) U.S. Cl. ..... 315/3; 313/417; 313/450; 313/456

(58) Field of Search ..... 315/3; 313/456, 313/448, 449, 450, 417

(56) References Cited

U.S. PATENT DOCUMENTS 4,786,842 A * 11/1988 Shimoma et al. ..... 313/417

* cited by examiner

*Primary Examiner*—David Vu

(74) *Attorney, Agent, or Firm*—Antonelli, Terry, Stout & Kraus, LLP

(57) ABSTRACT

A color cathode ray tube has an electron gun in its neck portion. The electron gun includes plural focus electrodes and an anode fixed in axially spaced relationship by two support rods. The electron gun also includes a voltage-dividing resistor for producing a voltage applied to a first focus electrode by dividing a voltage applied to the anode, and a metal conductor surrounding the resistor and fixed to a second focus electrode upstream of the first focus electrode. The resistor is disposed in the vicinity of one of the support rods, is formed of an insulating film, a resistance pattern, and a substrate disposed in the order named from the insulating film toward the neck portion. The resistance pattern is such that a potential difference between the metal conductor and a portion of the resistance pattern facing the metal conductor is equal to or smaller than 4 kV.

8 Claims, 9 Drawing Sheets

COLOR CATHODE RAY TUBE HAVING AN INTERNAL VOLTAGE-DIVIDING RESISTOR

BACKGROUND OF THE INVENTION

The present invention relates to a color cathode ray tube, and in particular to a color cathode ray tube provided with an internal voltage-dividing resistor for applying a plurality of different voltages to a plurality of electrodes constituting an electron gun housed in its neck portion, and a conductor for increasing a withstand voltage disposed in a space between the internal voltage-dividing resistor and the inner wall of the neck portion.

A color cathode ray tube used in TV receivers or monitors of information terminals has an electron gun housed within a neck portion of its vacuum envelope for projecting plural electron beams and a phosphor screen (a viewing screen) formed of phosphor elements coated on an inner surface of its panel portion for emitting light of plural colors. A deflection yoke is mounted around the outside of the vacuum envelope for scanning the electron beams from the electron gun on the phosphor screen two-dimensionally to produce a desired image.

In many color cathode ray tubes, a shadow mask serving as a color selection electrode is closely spaced from the phosphor screen such that each of the plural electron beams emitted from the electron gun impinges upon the phosphor elements of its intended color to produce a color image.

For the purpose of improving the quality of a color image over the display screen formed on the phosphor screen, a color cathode ray tube is known which employs an electron gun of the type applying a plurality of high voltages other than its anode voltage to a plurality of electrodes focusing the electron beams.

FIG. 7 is a partially cut-away side view of an essential part of a color cathode ray tube incorporating an electron gun provided with an internal voltage-dividing resistor, and FIG. 8 is a partially cut-away side view of the essential part of the color cathode ray tube of FIG. 7 as viewed in the direction of an arrow A in FIG. 7.

The electron gun for projecting three in-line electron beams is housed within a neck portion 32 of a vacuum envelope 10 of the color cathode ray tube. This electron gun comprises an anode (the sixth grid electrode) supplied with a highest voltage (an anode voltage, 27 kv, for example) 1, an intermediate grid electrode 2 supplied with a voltage (15 kV, for example) obtained by dividing the anode voltage using the internal voltage-dividing resistor, cathodes K (which are supplied with video signal voltages) for emitting the electron beams, a fifth grid electrode group 3 (which are supplied with about 7.7 kV, for example) comprised of plural electrodes constituting a lens for focusing the electron beams emitted from the cathodes K, the fourth grid electrode 4 (which is supplied with 700 V, for example), the third grid electrode 5 (which is supplied with 7.7 kV, for example), the second grid electrode 6 (which is supplied with 700 V, for example), and the first grid electrode 7 (which is grounded, for example). The electrodes 1 to 7 are fixed in the specified order with specified respective spacings therebetween by embedding portions of peripheries of the respective electrodes into a pair of insulating support rods 9.

A shield cup 8 is attached to the sixth grid electrode 1, and ends of electrically conductive springs 11 are welded to a sidewall of a front end of the shield cup 8. A portion of the inner wall of the vacuum envelope 10 is coated with an internal conductive film 10*a* made of material such as graphite and extending from the funnel portion toward the neck portion. The other ends of the electrically conductive springs 11 press on the internal conductive film 10*a* such that the anode voltage is supplied to the sixth grid electrode 1 via a high-voltage terminal embedded in the funnel portion.

An internal voltage-dividing resistor 12 of a configuration explained subsequently is attached to an outside surface of one of the insulating support rods 9 facing an inner wall 32*a* of the neck portion. The internal voltage-dividing resistor 12 is provided with terminals 13, 14 and 15 for electrical connection, the terminal 13 at one end of the resistor 12 is electrically connected to the sixth grid electrode 1 to be supplied with the anode voltage, the terminal 14 at the intermediate position of the resistor 12 is connected to the intermediate grid electrode 2, and the terminal 15 at the other end of the resistor 12 is connected to ground.

The terminal 13 is provided with a connecting tab 13*a* projecting perpendicularly to the longitudinal axis of the electron gun, and the connecting tab 13*a* is connected to the sixth grid electrode 1. A connecting tab 14*a* projects from the terminal 14, and is connected to the intermediate grid electrode 2 to supply thereto a high voltage obtained by dividing the anode voltage by a factor of the ratio of the resistors of the internal voltage-dividing resistor. The terminal 15 is connected to one of stem pins 45 by using an extension of a connecting tab 15*a* or another member such that the terminal 15 is connected to a potential such as ground potential (hereinafter ground potential) outside the cathode ray tube.

A conductor 16 made of a metal wire is disposed to pass through a space between the inner wall 32*a* of the neck portion 32 and the internal voltage-dividing resistor 12 and surround the internal voltage-dividing resistor 12 and one of the insulating support rods 9 mounting the resistor 12, and is welded to one electrode of the fifth grid electrode group 3 on opposite sides of the one of the insulating support rods 9.

The conductor 16 is made of nickel or stainless steel of 1 mm in width, for example. A portion of metal contained in the conductor 16 is evaporated by heating the conductor 16 using an external high-frequency induction heater after the completed electron gun assembly has been sealed into the neck portion 32 so as to form a metal thin film 16*a* on the inner wall 32*a* of the neck portion, the insulating support rod 9 and the internal voltage-dividing resistor 12 and thereby to produce stable electric potential on the inner wall of the neck portion during operation of the cathode ray tube. Another type of a conductor 16 is also known which uses an extension of a metal wire for connecting together electrodes to be supplied with the same voltage within the cathode ray tube, and still another type of a conductor 16 is also known which has only one of its two ends fixed to the electrode with the other end being not fixed to the electrode.

Reference numeral 17 denotes a conductive film for preventing spark, and the conductive film 17 is a sputtered film of Au—Pd, or Cr, for example, is formed on the surface of the internal voltage-dividing resistor 12 facing the inner wall of the neck portion, and enhances the effects of spot knocking by preventing spark between the conductor 16 and its neighboring electrodes during the spot knocking procedure described subsequently.

FIGS. 9A to 9C are illustrations of the internal voltage-dividing resistor 12 employed in the electron gun of FIG. 7, FIG. 9A is a plan view of the internal voltage-dividing resistor 12 as viewed from its resistance pattern side, and FIGS. 9B and 9C are its side and rear views, respectively.

In the internal voltage-dividing resistor 12, a resistance layer 19 having specified resistance characteristics is formed on one surface of an insulating substrate 18 which is preferably made of ceramic by initially printing a resistance material having desired resistance characteristics such as metal oxide including ruthenium oxide in the form of a desired pattern, and then drying and firing the resistance material.

The pattern (hereinafter also called the resistance pattern 19) of the resistance layer 19 is comprised mainly of plural meandering portions 19*a* which are located at plural positions and extend meanderingly in a direction of the tube axis (not shown) of the cathode ray tube, a trimming portion 19*b*, and a linear portion 19*c* which extends approximately in parallel with the tube axis. Two ends of the resistance pattern 19 are connected to the terminals 13, 15, and its intermediate point is connected to the intermediate terminal 14.

After forming the resistance pattern 19 of this configuration on the insulating substrate 18, a first insulating film 20*a* made of glass, of a borosilicate lead system, for example, is formed to cover the resistance pattern 19. Similarly a second insulating film 20*b* is formed over the approximately entire area of the rear surface of the insulating substrate 18 except for regions formed with terminals, and further, a spark-preventing conductive film 17 is coated on the specified portion of the second insulating film 20*b*. The spark-preventing conductive film 17 is somewhat displaced toward the high-voltage terminal 13 from a portion of the internal voltage-dividing resistor 12 facing the conductor 16. The spark-preventing conductive film 17 is formed by bombarding a target made of Au—Pd or Cr with ions and thereby sputtering Au—Pd or Cr onto the second insulating film 20*b* covered with a stainless steel mask having an opening of the specified shape.

The terminal 13 formed at one end of the internal voltage-dividing resistor 12 is connected to the sixth grid electrode 1 by the connecting tab 13*a* projecting from the terminal 13, the terminal 15 formed at the other end of the internal voltage-dividing resistor 12 is connected to an electrode piece at ground potential by the connecting tab 15*a* projecting from the terminal 15, and the terminal 14 formed at the intermediate position of the internal voltage-dividing resistor 12 is connected to the intermediate electrode 2 by the connecting tab 14*a* projecting from the terminal 14.

Conductive films (connection leads) 13*b*, 14*b* and 15*b* are provided at and connected to the positions of the resistance layer 19 corresponding to the connecting tabs 13*a*, 14*a* and 15*a*, respectively, and the connecting tabs 13*a*, 14*a* and 15*a* are clamped to the conductive films 13*b*, 14*b* and 15*b*, respectively, as by eyelet-riveting. The conductive films (the connection leads) 13*b*, 14*b* and 15*b* are not covered by the insulating film 20*a* which covers the resistance layer 19, and therefore they are exposed.

Color cathode ray tubes incorporating internal voltage-dividing resistors of this kind are disclosed in Japanese Utility Model Application Laid-open No. Sho 55-38484 (laid-open on Mar. 12, 1980), and Japanese Patent Application Laid-open Hei 7-94117 (laid-open on Apr. 7, 1995), for example. Further, the development of an electron gun employing an internal voltage-dividing resistor is reported in "Development of a NEXT Electron Gun for 46 cm 100° Narrow Neck Color Display Tubes," Technical Report of the Institute of Electronics, Information and Communication Engineers, EID99-99 (2000-01), Electronic Display, Jan. 28, 2000.

SUMMARY OF THE INVENTION

It is one of the present invention to provide a color cathode ray tube employing an electron gun provided with an internal voltage-dividing resistor having superior withstand voltage characteristics and capable of providing a high-definition image display.

To achieve the above object, in accordance with an embodiment of the present invention, there is provided a color cathode ray tube including a vacuum envelope having a panel portion with a phosphor screen formed on an inner surface thereof, a neck portion, and a funnel portion connecting the panel portion and the neck portion, and an electron gun housed in the neck portion, the electron gun comprising: an electron beam generating section; a plurality of focus electrodes; an anode, the electron beam generating section, the plurality of focus electrodes, and the anode being arranged in the order named, and fixed in predetermined axially spaced relationship by a pair of insulating support rods for focusing three electron beams emitted from the electron beam generating section onto the phosphor screen; a voltage-dividing resistor for producing an intermediate voltage to be applied to a first one of the plurality of focus electrodes adjacent to the anode by dividing a voltage applied to the anode, the voltage-dividing resistor being disposed in the vicinity of a surface of one of the pair of insulating support rods on a side thereof facing toward an inner wall of the neck portion, the voltage-dividing resistor comprising an insulating film, a resistance pattern, and an insulating substrate disposed in the order named from the insulating film toward the inner wall of the neck portion; and a metal conductor surrounding the voltage-dividing resistor and the one of the pair of insulating support rods and fixed to a second one of the plurality of focus electrodes, the second one of the plurality of focus electrodes being disposed upstream of the first one of the plurality of focus electrodes in a path of the three electron beams, wherein the resistance pattern is such that a potential difference between the metal conductor and a portion of the resistance pattern facing the metal conductor is equal to or smaller than 4 kV.

The present invention is not limited to the above configuration, and various changes and modifications may be made without departing from the scope of the invention as defined in the appended claims.

BRIEF DESCRIPTION OF THE DRAWINGS

In the accompanying drawings, in which like reference numerals designate similar components throughout the figures, and in which.

DETAILED DESCRIPTION

In the manufacture of a color cathode ray tube, after the cathode ray tube has been exhausted of gases and sealed, it is subjected to the so-called spot-knocking (high-voltage stabilization) treatment. The color cathode ray tube is normally operated at an anode voltage of 25 to 30 kV. The spot-knocking (high-voltage stabilization) is carried out by applying a high voltage of about twice the normal anode voltage to the anode, and thereby forcing sparks between the electrodes of the electron gun assembly and between the electrodes and the inner wall of the neck portion and consequently, removing projections in the electrodes or foreign particles within the cathode ray tube such that sparks are prevented from occurring within the color cathode ray tube during the normal operation of the completed color cathode ray tube.

Figure 10:
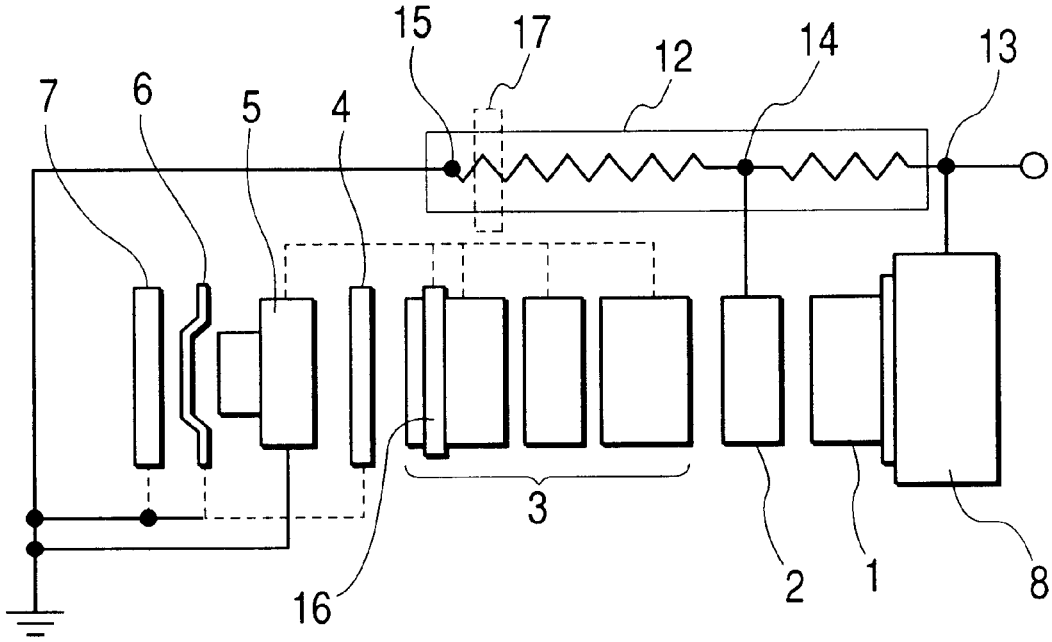
FIG. 10 is an electrical circuit diagram for explaining the electrical connection for the spot-knocking procedure.

FIG. 10 shows an example of an electrical configuration for spot-knocking the color cathode ray tube. The electrodes upstream of the fifth grid electrode group 3 in the electron beam path are connected together and grounded as indicated by broken lines, the sixth grid electrode 1 serving as the anode is supplied with twice the normal anode voltage, and the intermediate grid electrode 2 is supplied with a high spot-knocking voltage obtained by dividing the high voltage applied to the anode using the internal voltage-dividing resistor 12. In the spot-knocking procedure, the above-described conductor 16 grounded, and since it is disposed to surround the internal voltage-dividing resistor 12 stacked on the insulating support rod 9, and therefore it is brought close to the inner wall of the neck portion, strong spark is generated between the anode 1 and the conductor 16.

The internal voltage-dividing resistor 12 is arranged such that its front surface having the resistance pattern 19 and a first insulating film 20*a* thereon faces the insulating support rod 9 and its rear surface having a second insulating film 20*b* thereon faces the conductor 16 and the inner wall 32*a* of the neck portion.

In the spot-knocking procedure, the resistance pattern 19 of the internal voltage-dividing resistor 12 is also supplied with a high voltage of 25 to 30 kV, and spark is generated between the conductor 16 usually at ground potential and a portion of the internal voltage-dividing resistor 12 facing the conductor 16 through the insulating substrate 18 and the second insulating film 20*b*. This spark produces cracks in the first and second insulating films 20*a*, 20*b*, and broken pieces of glass from the cracked first and second insulating films 20*a*, 20*b* are scattered within the cathode ray tube. Some of the scattered broken pieces of glass physically block the electron beam passing apertures in the shadow mask, and produce adverse effects on the high-definition display performance, and others of the scattered broken pieces of glass are lodged between electrodes of the electron gun, and deteriorate withstanding voltage characteristics of the electron gun. As explained above, there have been various problems caused by scattering of fragments of glass from the cracked insulating films.

Further, there is a fatal problem in that occurrence of sparks damages circuits in equipment such as a monitor incorporating the color cathode ray tube. Occurrence of sparks causes problems during normal operation of the cathode ray tube as well as during the spot-knocking procedure. Although a potential difference between the conductor 16 and a portion of the resistance pattern 19 facing the metal conductor 16 is about 5 to 7 kV under the normal operating condition of the cathode ray tube, and is smaller compared with that during the spot-knocking procedure, sparks are generated in a space between the conductor 16 and the portion of the resistance pattern 19 and in the vicinities of the space because of synergism of continuance of the same operating condition for many hours and the temperature rise of the whole color cathode ray tube housed in a cabinet of equipment, and consequently, a fatal problem arises in that the circuits in the equipment incorporating the cathode ray tube are damaged in addition to the above problem with the color cathode ray tube itself caused by cracks in the glass films.

As a means for solving the above problems, Japanese Patent Application Laid-open No. Hei 7-94117 discloses a technique which prevents the internal voltage-dividing resistor from being damaged by connecting a metal ring (which corresponds to the above-described conductor 16) to one of two electrodes which are internally connected together and are supplied with a voltage divided by the internal voltage-dividing resistor, extending a terminal of the internal voltage-dividing resistor for supplying the divided voltage to the other of the two electrodes so as to face the metal ring and equalize the potential of the extension of the terminal with that of the metal ring, and thereby suppressing the occurrence of migration of alkaline ions. This technique is effective for a case in which the metal ring is connected to the electrode supplied with the voltage divided by the internal voltage-dividing resistor, but generally the conductor (the metal ring) is attached to an electrode supplied with a comparatively low voltage (an electrode nearer to the first grid electrode of the electron gun so as to improve withstand voltage characteristics, and therefore this prior art technique cannot solve the problems completely.

Now, the embodiments in accordance with the present invention will be explained in detail by reference to the drawings.

Figure 7:
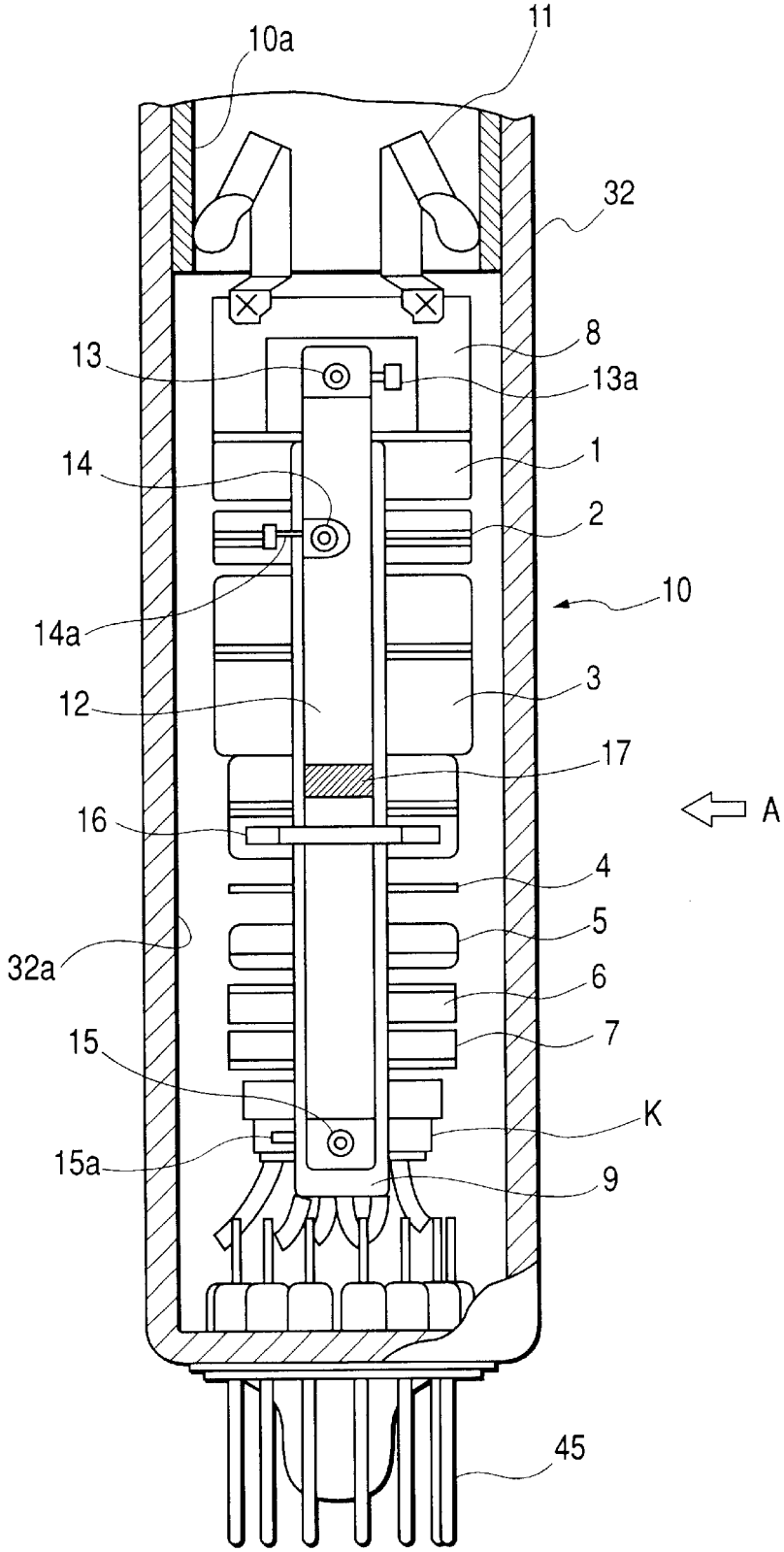
FIG. 7 is a partially cut-away side view of an essential part of a color cathode ray tube incorporating an electron gun provided with an internal voltage-dividing resistor.
Figure 8:
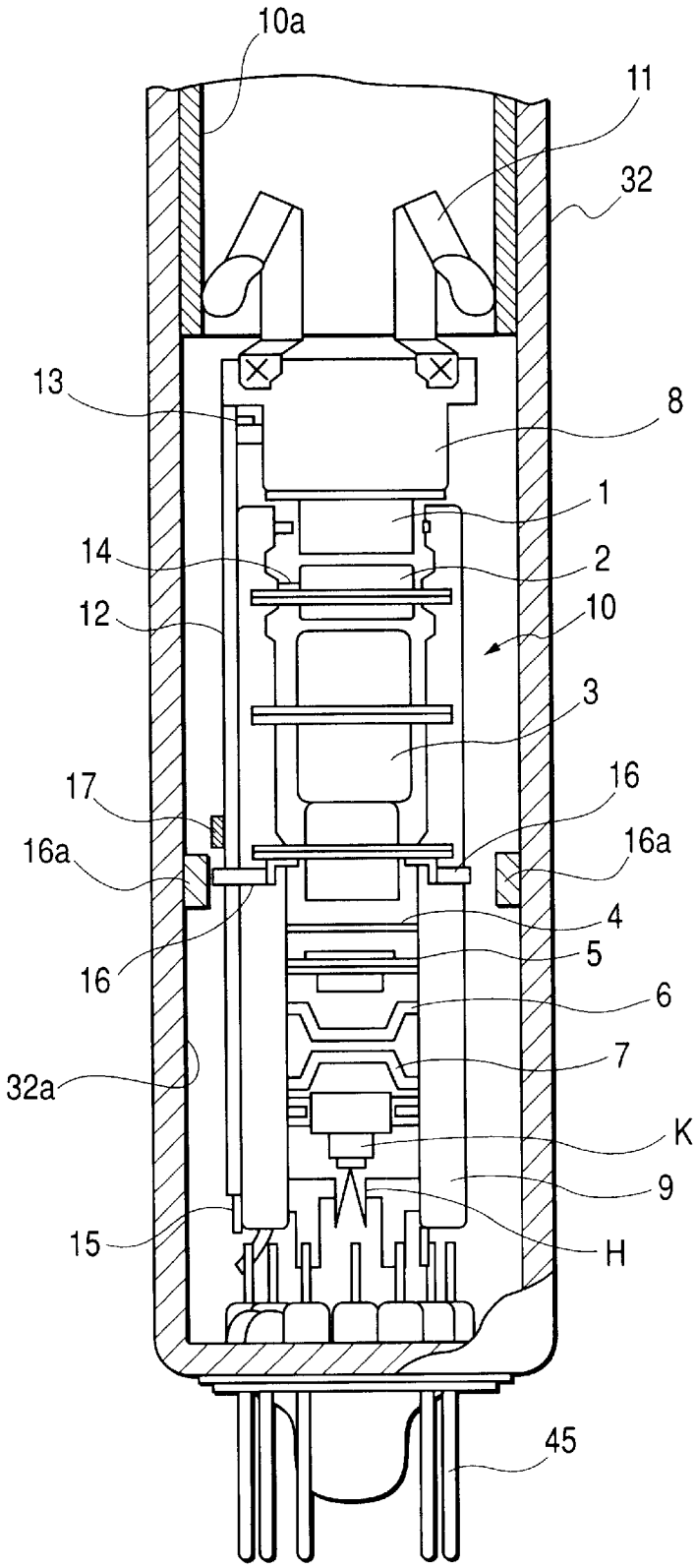
FIG. 8 is a partially cut-away side view of the essential part of the color cathode ray tube of FIG. 7 as viewed in the direction of an arrow A in FIG. 7.

This embodiment of the present invention is substantially similar to the color cathode ray tube shown in FIGS. 7 and 8, except for the configuration of the internal voltage-dividing resistor and its associated portions.

Figure 1A:
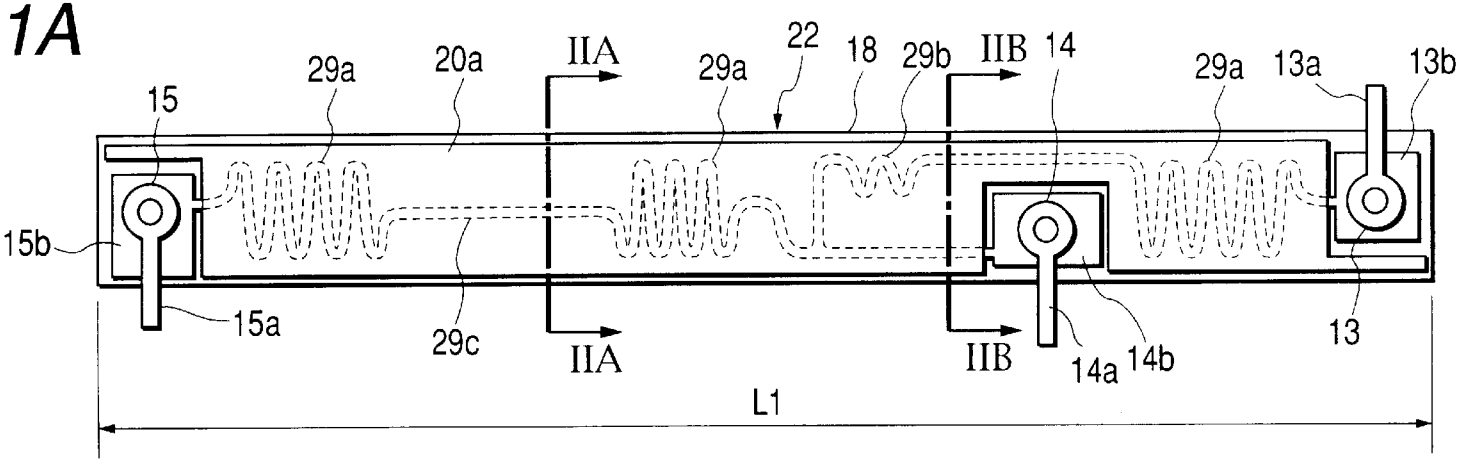
FIGS. 1A and 1B are illustrations of an internal voltage-dividing resistor employed in an electron gun of the color cathode ray tube in accordance with an embodiment of the present invention, FIG. 1A being a plan view of the internal voltage-dividing resistor, and FIG. 1B being a rear view of the internal voltage-dividing resistor of FIG. 1A.
Figure 1B:
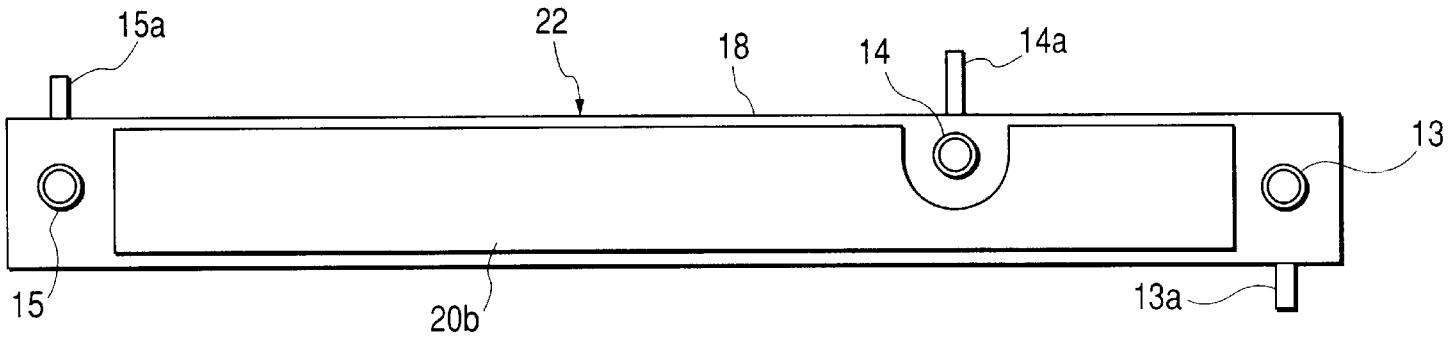
Figure 2A:
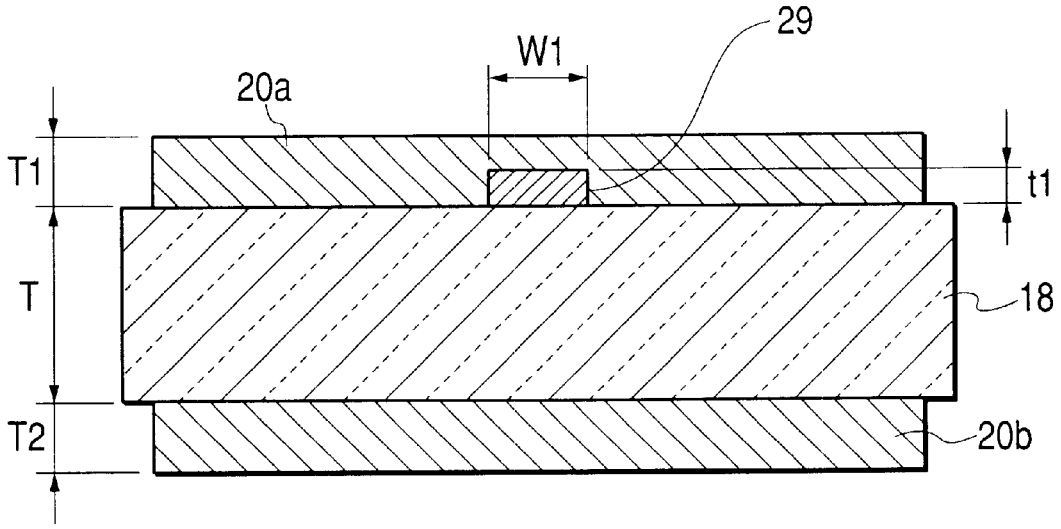
FIG. 2A is a schematic cross-sectional view of an essential part of the internal voltage-dividing resistor of FIG. 1A taken along line IIA—IIA of FIG. 1A.
Figure 2B:
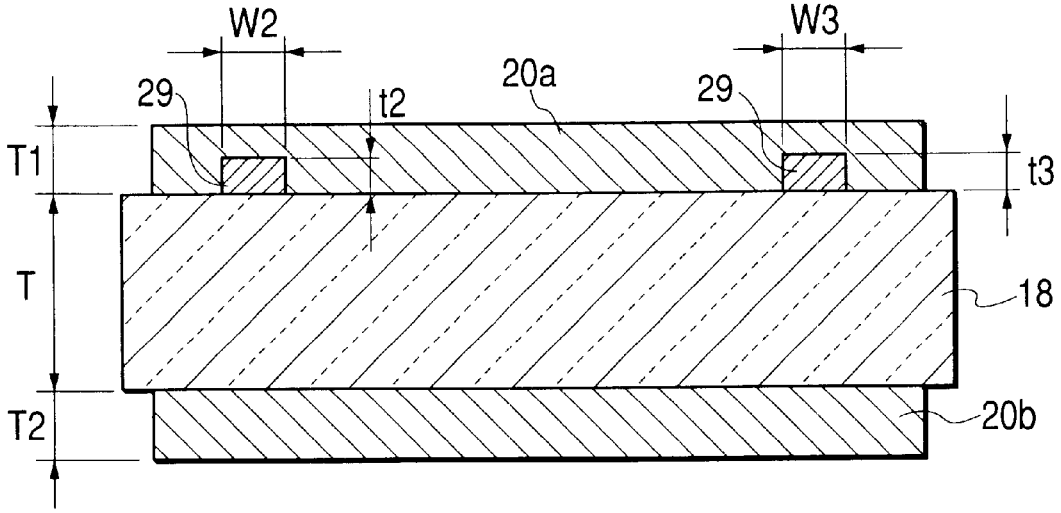
FIG. 2B is schematic cross-sectional view of an essential part of the internal voltage-dividing resistor of FIG. 1A taken along line IB—IIB of FIG. 1A.

FIGS. 1A and 1B are illustrations of an internal voltage-dividing resistor employed in an electron gun of the color cathode ray tube in accordance with an embodiment of the present invention, FIG. 1A is a plan view of the internal voltage-dividing resistor, and FIG. 1B is a rear view of the internal voltage-dividing resistor of FIG. 1A. FIG. 2A is a schematic cross-sectional view of an essential part of the internal voltage-dividing resistor of FIG. 1A taken along line IIA—IIA of FIG. 1A, and FIG. 2B is a schematic cross-sectional view of an essential part of the internal voltage-dividing resistor of FIG. 1A taken along line IIB—IIB of FIG. 1A. The same reference numerals as utilized in FIGS. 9A–9C designate corresponding portions in FIGS. 1A, 1B, 2A and 2B.

Figure 9A:
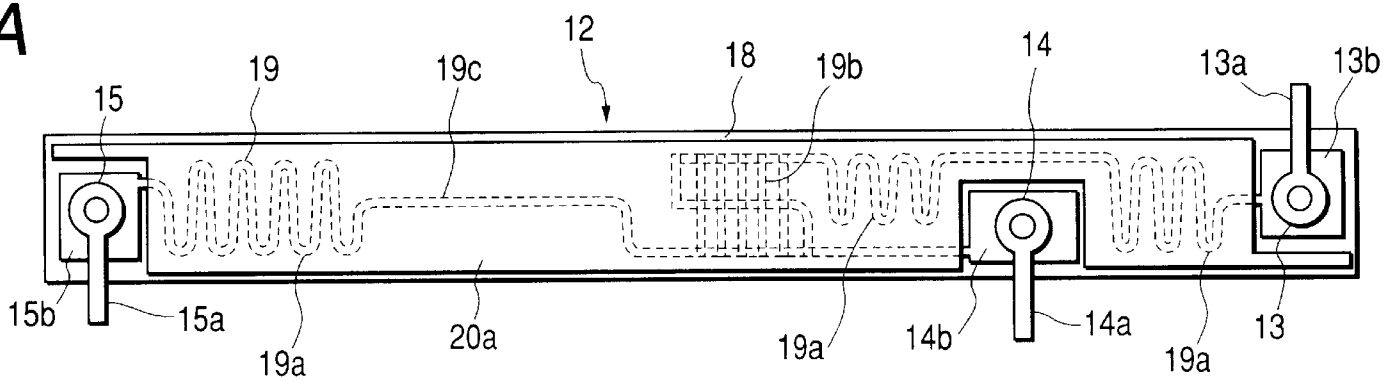
FIGS. 9A to 9C are illustrations of an internal voltage-dividing resistor employed in an electron gun, FIG. 9A being a plan view of the internal voltage-dividing resistor, FIG. 9B being a side view thereof, and FIG. 9C being a rear view thereof.
Figure 9B:
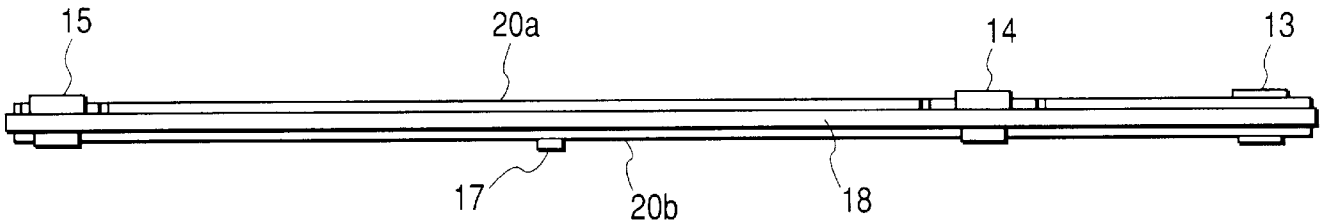
Figure 9C:
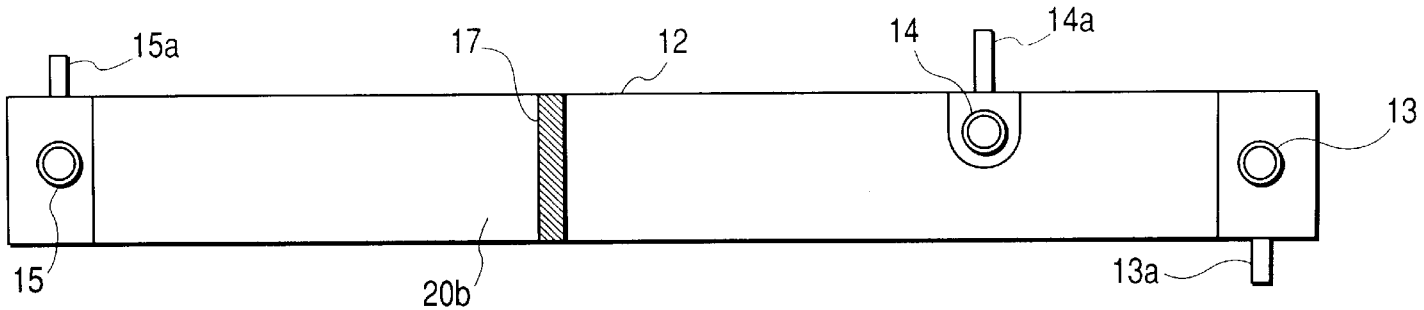

In an internal voltage-dividing resistor 22, before it is attached to the electron gun, shown in FIGS. 1A, 1B, 2A and 2B, a resistance pattern 29 having specified resistance characteristics is formed on one surface of an insulating substrate 18 which is preferably made of ceramic by initially printing a resistance material having specified resistance characteristics such as metal oxide including ruthenium oxide in the form of a desired pattern as by screen printing, and then drying and firing the resistance material, as in the case of the conventional internal voltage-dividing resistor explained in connection with FIGS. 9A–9C.

The resistance pattern 29 is comprised mainly of plural meandering portions 29*a* which are distributed at plural positions and extend meanderingly in a direction of the tube axis (not shown) of the cathode ray tube, an intermediate portion 29*b* which has replaced the conventional portion, and a linear portion 29*c* which extends approximately in parallel with the tube axis. Two ends of the resistance pattern 29 are connected to the terminals 13, 15, and its intermediate point is connected to the terminal 14.

The resistance pattern 29 is configured such that the linear portion 29*c* faces the conductor 16 and its resistance is distributed to make a potential difference between the conductor 16 and a portion of the resistance pattern 29 facing the conductor 29 equal to or smaller than an acceptable level described subsequently during normal operation of the cathode ray tube.

In this embodiment, the resistance pattern 29 has a plan view of FIG. 1A, the width W1 in the cross section of the linear portion 29*c* of the resistance pattern 29 is made greater as shown in FIG. 2A than the pattern widths W2 and W3 of the intermediate portion 29*b* shown in FIG. 2B, and in this embodiment the width W1 is double the width W2, W3. The thickness t1 of the linear portion 29*c* is the same as the thickness t2, t3 of the intermediate portion 29*b*. The resistances of the resistance pattern 29 are adjusted so that the potential difference between the conductor 16 and the portion of the resistance pattern 29 facing the conductor 29 is reduced to two-thirds (8.7 kV, for example) of the potential (13.1 kV, for example)in the conventional cathode ray tube. Connecting tabs 13*a*, 14*b* and 15*b* for electrical connection to the high-voltage electrode, the intermediate electrode, and ground potential, respectively, projecting from the internal voltage-dividing resistor 29 are clamped to the internal voltage-dividing resistor 29, as by eyelet-rivetting.

An insulating film 20*a* having a composition described subsequently is formed to a thickness T1 so as to cover the resistance layer 29, and the internal voltage-dividing resistor 22 is incorporated into the color cathode ray tube such that the insulating film 20*a* faces one of the insulating support rods of the electron gun. On the other hand, a second insulating film 20*b* having a composition described subsequently is formed to a thickness T2 on the rear surface of the insulating substrate 18, and the second insulating film 20*b* is disposed to face the inner wall 32*a* of the neck portion.

In this embodiment, the area of the cross section of the portion of the resistance pattern 29 facing the conductor 16 is made larger than that of the remainder of the resistance pattern 29, this reduces the resistance value of the portion of the resistance pattern 29 facing the conductor 16, resulting in prevention of generation of Joule heat and suppression of temperature rise, and consequently, occurrences of sparks are reduced. Further, since the portion of the resistance pattern 29 facing the conductor 16 is simply line-shaped, the area of the opposing portion of the resistance pattern 29 is small, and therefore the occurrences of sparks are reduced still more.

The remaining components in this embodiment are similar to corresponding ones of the conventional color cathode ray tube already explained, and repetition of their explanations is omitted.

The following explains an example of a method of fabricating the internal voltage-dividing resistor 22.

Initially, an insulating substrate 18 is prepared which is made of material of alumina containing at least 96 weight percent of A1, and has a thickness T of 0.635 mm, a width of 5 mm, and a length L1 of 58 mm. Then a resistance pattern made principally of ruthenium oxide and intended for the resistance pattern 29 is screen-printed on a surface of the insulating substrate 18 which has been formed with the terminals 13 to in advance by using material approximately similar to that of the resistance pattern. Then, after drying, the resistance pattern is fired at 850° C. to form the resistance pattern 29.

Next, a paste of glass of the borosilicate lead glass system having a Composition Example 1 shown below is coated except for portions of the ends of the resistance pattern 19 so as to cover the resistance pattern 19 to such a coating thickness that the thickness of the glass film becomes 0.15 mm after being fired.

Composition Example 1 of Glass of the Borosilicate Lead Glass System

| | |
|---|---|
| lead oxide | 55 weight percent |
| silicon oxide | 29 |
| boron oxide | 8 |
| aluminum oxide | 4 |
| others | the balance |

A paste of glass of the borosilicate lead glass system having the Composition Example 1 is coated on the rear surface of the insulating substrate 18 except for portions of its ends to such a coating thickness that the thickness of the glass film becomes 0.25 mm after being fired.

After drying, the glass films are fired at 600° C. for 40 minutes, the first insulating film 20*a* having a thickness T1 of 0.15 mm and the second insulating film 20*b* having a thickness T2 of 0.25 mm are obtained to provide the internal voltage-dividing resistor 22.

The dimensions are as follows:

| | |
|---|---|
| Distance between the terminals 13 and 14 | 14 mm |
| Distance between the terminals 14 and 15 | 40 mm |
| Exposed length at the two ends of the rear surface | 3.5 mm |

In the usual internal voltage-dividing resistor, its overall length L1 is in a range from 50 mm to 100 mm, its width is in a range from 5 mm to 10 mm, and its overall thickness including the two films on the two surfaces and the terminals is in a range from 1 mm to 2 mm.

In the internal voltage-dividing resistor fabricated as described above, both the first insulating film 20*a* covering the resistance pattern 29 and the second insulating film 20*b* on the rear surface are formed of the glass of the borosilicate lead glass only, and therefore occurrence of migration of alkaline ions is suppressed such that insulating characteristics between portions of the resistance pattern and between the resistance pattern and the terminals are sufficiently ensured. Utilization of the borosilicate lead system glass containing at least 20 weight percent of lead oxide prevents warping or bending of the internal voltage-dividing resistor, makes possible firing of the insulating film at a temperature lower than a firing temperature of about 850° C. required for glass of other systems used for the same purpose, and consequently, there is no possibility that the resistance pattern is damaged by firing required for fabrication of the insulating film.

Another advantage of suppression of secondary electron emission is provided by including the oxide of transition metal such as iron oxide or cobalt oxide in the borosilicate lead system glass of the second insulating film 20*b* on the rear surface of the internal voltage-dividing resistor.

Moreover, when the thickness of the first insulating film 20*a* on the front surface of the internal voltage-dividing resistor 22 is selected to be smaller than that of the second insulating film 20*b,* in addition to prevention of the warping or bending of the internal voltage-dividing resistor, the withstand voltage characteristics are capable of being improved further.

The following is another example of glass of the borosilicate lead glass system constituting the insulating films of the internal voltage-dividing resistor employed in the present invention.

Composition Example 2 of Glass of the Borosilicate Lead Glass System

| | |
|---|---|
| lead oxide | 55 weight percent |
| silicon oxide | 27 |
| boron oxide | 10 |
| aluminum oxide | 5 |
| iron oxide | 3 |

As mentioned above, this embodiment of the present invention is substantially similar to the color cathode ray tube explained in connection with FIGS. 7 and 8, except for the configuration of the internal voltage-dividing resistor and its associated portions.

Figure 3:
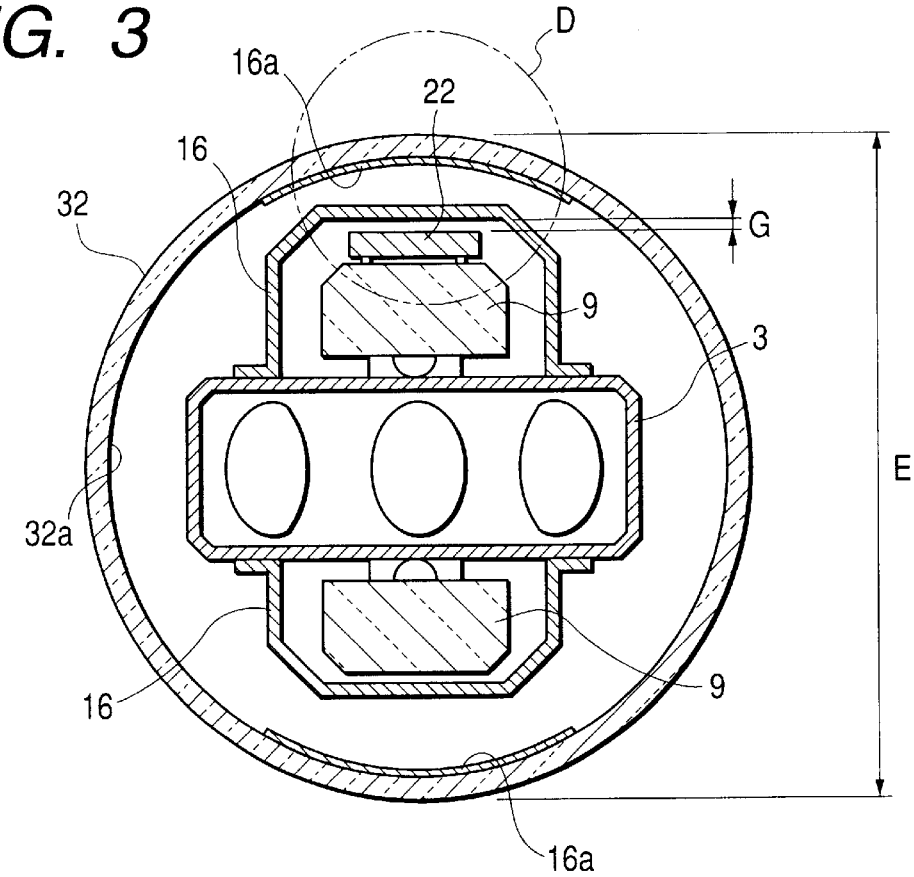
FIG. 3 is a vertical cross-sectional view of a neck portion of a color cathode ray tube in accordance with the embodiment of the present invention taken along a plane perpendicular to its tube axis.
Figure 4:
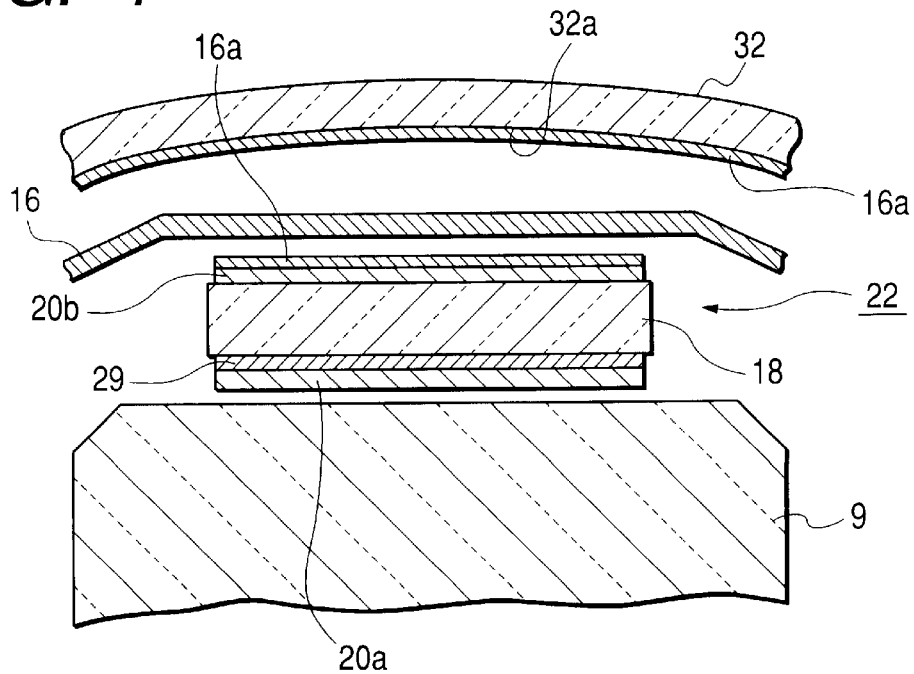
FIG. 4 is an enlarged cross-sectional view of a portion of the neck portion indicated by "D" of FIG. 3.

FIG. 3 is a cross-sectional view of a neck portion 32 of a color cathode ray tube in accordance with an embodiment of the present invention taken along a plane passing through the conductor 16 and perpendicular to its tube axis, and FIG. 4 is an enlarged cross-sectional view of a portion of the neck portion indicated by "D" of FIG. 3. The same reference numerals as utilized in FIGS. 1A, 1B, 2A, 2B, 7,8, 9A–9C and 10 designate corresponding portions in FIGS. 3 and 4.

In FIGS. 3 and 4, the internal voltage-dividing resistor 22 is disposed outside of one of a pair of insulating support rods 9, that is, on the side of the one of the insulating support rods 9 facing the inner wall 32*a* of the neck portion 32, and the conductor 16 is disposed to surround the internal voltage-dividing resistor 22 and the insulating support rod 9 mounting the resistor 22 in a space between the inner wall 32*a* of the neck portion and the internal voltage-dividing resistor 22 and is welded at its two ends to the fifth grid electrode 3.

Similarly, another conductor 16 is disposed to surround the other one of the two insulating support rods 9 not mounting the internal voltage-dividing resistor 22. Reference numeral 16*a* denote metal films which are evaporated films formed by heating the conductors 16. The evaporated films are deposited on the inner wall 32*a* of the neck portion, the internal voltage-dividing resistor 22, the insulating support rods 9 and others (the evaporated films on the support rods 9 are not shown in FIGS. 3 or 4).

The internal voltage-dividing resistor 22 is arranged such that the resistance pattern 29 and the first insulating film 20*a* covering it face one of the insulating support rods 9, and the second insulating film 20*b* on its rear faces the inner wall 32*a* of the neck portion.

In FIG. 3, a gap G between the conductor 16 and the portion of the internal voltage-dividing resistor 22 facing the conductor 16 is in a range from 0.1 mm to 0.5 mm, for example, when the outside diameter E of the neck portion 32 is 29 mm.

Figure 5:
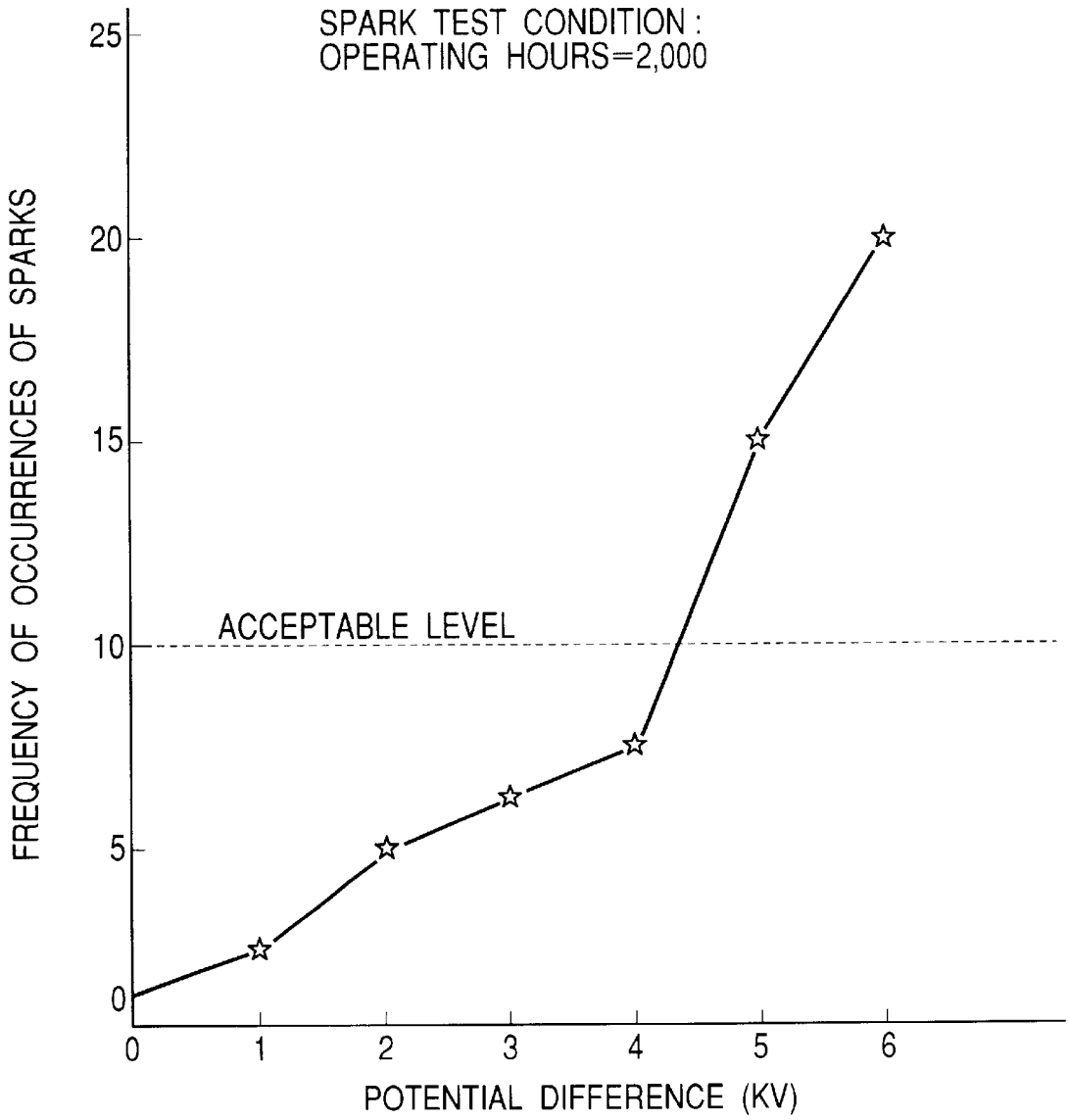
FIG. 5 is a graph showing a relationship between frequency of occurrences of sparks and a potential difference between a metal conductor and a portion of a resistance pattern of the internal voltage-dividing resistor facing the metal conductor in a color cathode ray tube.

FIG. 5 is a graph showing a relationship between frequency of occurrences of sparks and a potential difference between the metal conductor 16 and a portion of the resistance pattern 29 of the internal voltage-dividing resistor 22 facing the metal conductor 16 for 2,000 hours of operation of a color cathode ray tube employing the internal voltage-dividing resistor. The color cathode ray tube tested employed the internal voltage-dividing resistor shown in FIGS. 1A and 1B. The potential differences between the metal conductor 16 and the portion of the resistance pattern 29 of the internal voltage-dividing resistor 22 facing the metal conductor 16 were varied by varying a voltage externally applied to the electrode of the electron gun. The potentials of the portion of the resistance pattern 29 facing the metal conductor 16 are calculated based upon the ratio between the length measured from the portion of the resistance pattern 29 facing the conductor 16 to one end of the resistance pattern 29 and the total length of the resistance pattern 29.

In the test, the color cathode ray tube was placed in a thermostatic chamber at 40° C., its anode was supplied with a fixed voltage of 27 kV (a normal operating voltage), and a voltage applied to the third grid electrode 5 and the fifth grid electrode 3 was adjusted to provide the respective potential differences plotted as abscissas of FIG. 5. The remainder of the electrodes were supplied with the respective specified voltages. The temperature of the internal voltage-dividing resistor 22 was elevated to about 150°C.

FIG. 5 shows frequency of occurrences of sparks in the color cathode ray tube when it was operated for 2,000 hours with the potential difference between the conductor 16 and the portion of the resistance pattern 29 facing the conductor 16 kept at each of the potential differences plotted as abscissas of FIG. 5 under the above-explained conditions.

As is apparent from FIG. 5, the frequency of occurrences of sparks rises steeply when the potential difference between the conductor 16 and the portion of the resistance pattern 29 facing the conductor 16 exceeds 4 kV, and consequently, there is a possibility of damaging circuit components of the cathode ray display set. If the potential difference between the conductor 16 and the portion of the resistance pattern 29 facing the conductor 16 is made less than or equal to 1 kV, the frequency of occurrences of sparks are made approximately zero.

The present inventors have confirmed experimentally that if the potential difference between the conductor 16 and the portion of the resistance pattern 29 facing the conductor 16 is made less than or equal to 4 kV, the resultant reduced frequency of occurrences of sparks presents no problems to equipment incorporating the color cathode ray tube.

Figure 6:
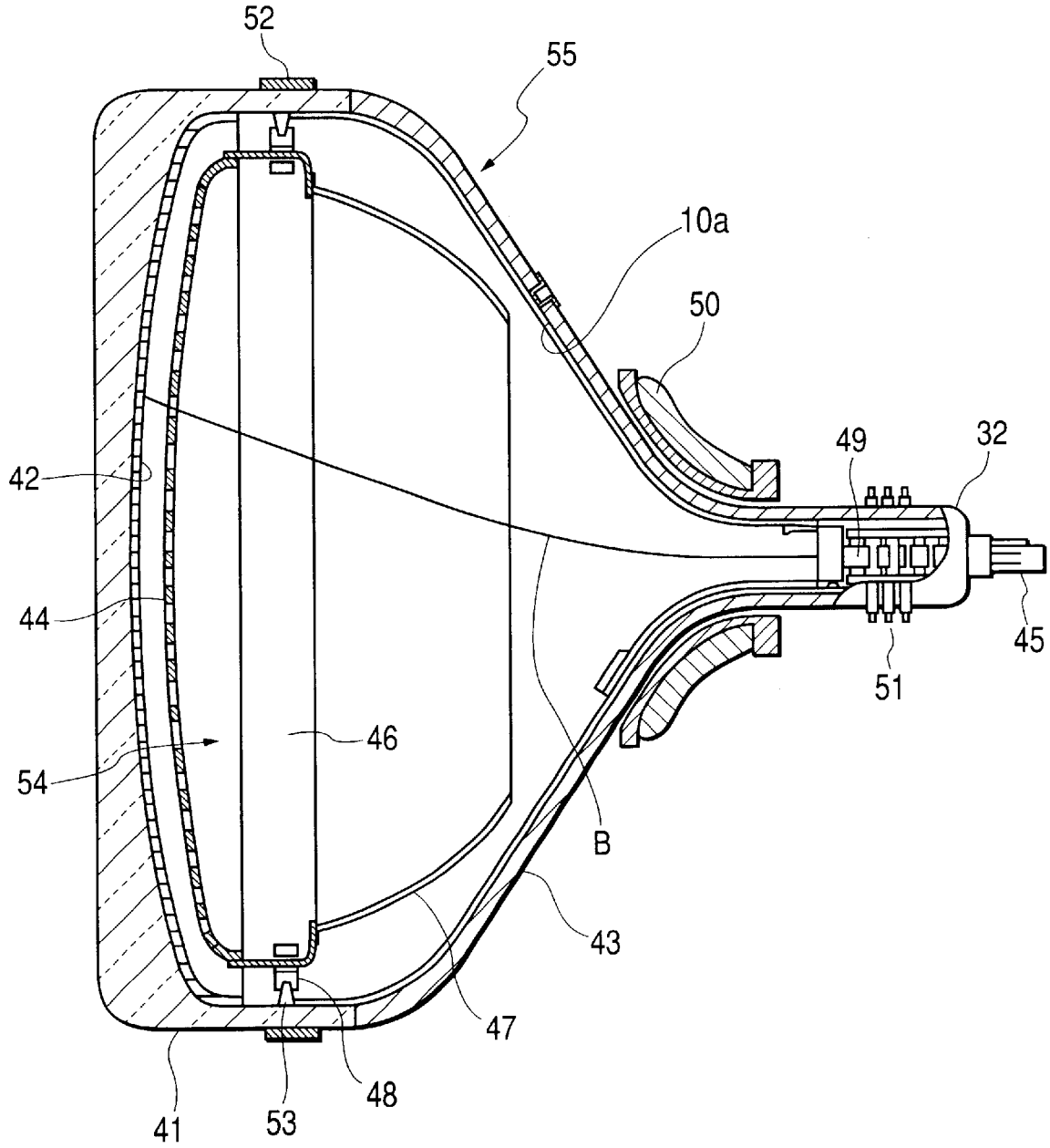
FIG. 6 is a schematic cross-sectional view of a color cathode ray tube in accordance with the embodiment of the present invention for explaining its exemplary overall configuration.

FIG. 6 is a schematic cross-sectional view of a color cathode ray tube in accordance with an embodiment of the present invention for explaining its exemplary overall configuration. In FIG. 6, reference numeral 41 denotes a panel portion, 42 is a phosphor screen, 32 is the neck portion housing the electron gun, 43 is a funnel portion connecting the panel portion 41 and the neck portion 32, 44 is a shadow mask, 46 is a mask frame, 47 is a magnetic shield, 48 is a mask suspension mechanism, 49 is an in-line type electron gun, 50 is a deflection yoke, 51 is an external magnetic correction device, 10*a* is an internal conductive coating, 52 is an implosion proofing band, 53 are panel pins, 54 is a shadow mask assembly, and 45 are the stem pins. In this color cathode ray tube, a vacuum envelope 55 is formed of the panel portion 41, the neck portion 32 and the funnel portion 43, and three electron beams B (one center electron beam and two side electron beams) are emitted from the electron gun 49 housed within the neck portion 32, and scan the phosphor screen 42 two-dimensionally by being subjected to horizontal and vertical deflection magnetic fields generated by the deflection yoke 50.

The three electron beams are intensity-modulated by signals such as video signals supplied via the stem pins 45, then are subjected to color selection by the shadow mask 44 disposed immediately in front of the phosphor screen 42, and then impinge upon respective phosphor elements of red, green and blue constituting the phosphor screen 42 so as to reproduce an intended color image. The in-line type electron gun 49 employs the internal voltage-dividing resistor of the configuration explained in connection with the preceding embodiments.

The present invention is not limited to the above configurations, and various changes and modifications may be made without departing from the scope of the invention. The present invention is not limited to a color cathode ray tube provided with an electron gun for emitting a plurality of electron beams, and is equally applicable to various types of cathode ray tubes employing an electron gun provided with an internal voltage-dividing resistor, including a single-electron-beam type cathode ray tube such as a projection type cathode ray tube.

As explained above, in the present invention, the internal voltage-dividing resistor is configured to have a resistance pattern such that a potential difference between the conductor and a portion of the resistance pattern facing the metal conductor is equal to or smaller than 4 kV, therefore the insulating films formed on the surfaces of the internal voltage-dividing resistor are prevented from being cracked and the temperature of the portion of the resistance pattern facing the metal conductor is prevented from being raised by Joule heat, thereby occurrence of sparks is suppressed, and consequently, the present invention provides a color cathode ray tube employing the electron gun provided with a superior internal voltage-dividing resistor having high-definition display and superior withstand voltage characteristics and also capable of preventing circuits of equipment incorporating the color cathode ray tube from being damaged.

What is claimed is:

1. A color cathode ray tube including a vacuum envelope having a panel portion with a phosphor screen formed on an inner surface thereof, a neck portion, and a funnel portion connecting said panel portion and said neck portion, and an electron gun housed in said neck portion, said electron gun comprising:

an electron beam generating section;

a plurality of focus electrodes;

an anode, said electron beam generating section, said plurality of focus electrodes, and said anode being arranged in the order named, and fixed in predetermined axially spaced relationship by a pair of insulating support rods for focusing three electron beams emitted from said electron beam generating section onto said phosphor screen;

a voltage-dividing resistor for producing an intermediate voltage to be applied to a first one of said plurality of focus electrodes adjacent to said anode by dividing a voltage applied to said anode, said voltage-dividing resistor being disposed in the vicinity of a surface of one of said pair of insulating support rods on a side thereof facing toward an inner wall of said neck portion, said voltage-dividing resistor comprising an insulating film, a resistance pattern, and an insulating substrate disposed in the order named from said insulating film toward said inner wall of said neck portion; and a metal conductor surrounding said voltage-dividing resistor and said one of said pair of insulating support rods and fixed to a second one of said plurality of focus electrodes, said second one of said plurality of focus electrodes being disposed upstream of said first one of said plurality of focus electrodes in a path of said three electron beams, wherein said resistance pattern is such that a potential difference between said metal conductor and a portion of said resistance pattern facing said metal conductor is equal to or smaller than 4 kV.

2. A color cathode ray tube according to claim 1, wherein said portion of said resistance pattern facing said metal conductor is of the shape of a line extending approximately in parallel with a longitudinal axis of said color cathode ray tube.

3. A color cathode ray tube according to claim 1, wherein an area of a cross section of said portion of said resistance pattern facing said metal conductor is greater than that of the remainder of said resistance pattern.

4. A color cathode ray tube according to claim 2, wherein an area of a cross section of said portion of said resistance pattern facing said metal conductor is greater than that of the remainder of said resistance pattern.

5. A color cathode ray tube according to claim 1, wherein said second one of said plurality of focus electrodes is adapted to be supplied with a voltage lower than a voltage supplied to said first one of said plurality of focus electrodes.

6. A color cathode ray tube according to claim 2, wherein said second one of said plurality of focus electrodes is adapted to be supplied with a voltage lower than a voltage supplied to said first one of said plurality of focus electrodes.

7. A color cathode ray tube according to claim 3, wherein said second one of said plurality of focus electrodes is adapted to be supplied with a voltage lower than a voltage supplied to said first one of said plurality of focus electrodes.

8. A color cathode ray tube according to claim 4, wherein said second one of said plurality of focus electrodes is adapted to be supplied with a voltage lower than a voltage supplied to said first one of said plurality of focus electrodes.

* * * * *